US008929179B2

(12) United States Patent
Matsuo

(10) Patent No.: US 8,929,179 B2
(45) Date of Patent: Jan. 6, 2015

(54) ANALOG ELECTRONIC TIMEPIECE HAVING ROTATING DISPLAY BODIES AND A DETECTION UNIT DETECTING WHEN A ROTATING DISPLAY BODY IS IN A PREDETERMINED REFERENCE DISPLAY MODE

(71) Applicant: Casio Computer Co., Ltd., Tokyo (JP)

(72) Inventor: Mitsuaki Matsuo, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/943,417

(22) Filed: Jul. 16, 2013

(65) Prior Publication Data

US 2014/0029387 A1 Jan. 30, 2014

(30) Foreign Application Priority Data

Jul. 30, 2012 (JP) ..... 2012-168507

(51) Int. Cl.

| | |
|---|---|
| ***G04C 9/00*** | (2006.01) |
| ***G04B 19/00*** | (2006.01) |
| ***G04G 9/00*** | (2006.01) |
| ***G04B 19/24*** | (2006.01) |

(52) U.S. Cl.

CPC . *G04G 9/00* (2013.01); *G04B 19/24* (2013.01)
USPC ..... 368/76; 368/187; 368/220

(58) Field of Classification Search

USPC ..... 368/28, 37, 76, 80–81, 184–189, 368/220–222
See application file for complete search history.

(56) References Cited

U.S. PATENT DOCUMENTS

| | | | | |
|---|---|---|---|---|
| 4,276,626 | A * | 6/1981 | Satoh et al. | 368/80 |
| 4,358,753 | A * | 11/1982 | Cascini | 341/2 |
| 6,038,523 | A * | 3/2000 | Akahane et al. | 702/150 |
| 6,731,571 | B2 * | 5/2004 | Yiu | 368/79 |
| 6,807,128 | B2 * | 10/2004 | Yiu | 368/220 |
| 2002/0186622 | A1 * | 12/2002 | Ogasawara | 368/157 |
| 2011/0141858 | A1 | 6/2011 | Aoki | |
| 2011/0249538 | A1 | 10/2011 | Aoki | |

FOREIGN PATENT DOCUMENTS

| | | | |
|---|---|---|---|
| JP | 2011-122902 | A | 6/2011 |
| JP | 2011-220872 | A | 11/2011 |

* cited by examiner

*Primary Examiner* — Sean Kayes
(74) *Attorney, Agent, or Firm* — Holtz, Holtz, Goodman & Chick PC

(57) ABSTRACT

An analog electronic timepiece comprising: a plurality of rotating display bodies; a gear train mechanism; a drive control unit; a detection unit; and a delay cycle counting unit, wherein the delay cycle counting unit adds 1 to the number of delay cycles in a case where it is determined, for each detection cycle of a predetermined reference display mode, that the first rotating display body is stopped during a rotation cycle of the first rotating display body based on detection results by the detection unit at a first timing and at a second timing, and the drive control unit rotationally moves the first rotating display body for a number of times, the number corresponding to the number of delay cycles, in a case where the first rotating display body is capable of operating at the first timing.

20 Claims, 6 Drawing Sheets

ANALOG ELECTRONIC TIMEPIECE HAVING ROTATING DISPLAY BODIES AND A DETECTION UNIT DETECTING WHEN A ROTATING DISPLAY BODY IS IN A PREDETERMINED REFERENCE DISPLAY MODE

BACKGROUND OF THE INVENTION

1. Field of the Invention

The present invention relates to an analog electronic timepiece capable of simultaneously displaying a time and a date.

2. Description of Related Art

Conventionally, there has been an analog electronic timepiece capable of displaying a date together with a time. In usual, such an electronic timepiece as described above includes a date indicator as a dial plate rotatably provided under a dial plate, and among marks indicating dates and provided on a peripheral edge portion of the date indicator, selectively exposes any thereof from a transparent small window provided on the dial plate, and thereby displays one date.

In the analog electronic timepiece, there are: a case where, owing to an external factor such as an influence of an external magnetic field and acceleration generated by a strong impact and the like, a motor that rotates hands does not operate normally, and hand positions memorized in a memory inside the timepiece and actual hand positions are shifted from each other; and a case where a power supply is reset and information about the memorized hand positions is lost. In this connection, an analog electronic timepiece has been heretofore developed, which has a function to periodically confirm that the positions of the respective hands are appropriate, and to correct the positions concerned when the hands are shifted from such appropriate positions. For example, in Japanese Patent Laid-Open Publication No. 2011-122902 (corresponding to US 2011/0141858 A1) and Japanese Patent Laid-Open Publication No. 2011-220872 (corresponding to US 2011/0249538 A1), technologies for detecting positions of a second hand and a minute hand surely and rapidly is disclosed.

Meanwhile, there is an analog electronic timepiece in which a configuration related to such detection of the hand positions is not provided for the date indicator, because a positional shift is less likely to occur since torque required for a rotation operation is large, because it is difficult to visually recognize an extremely small shift since a rotation angle per step is small, because no problem occurs on display information even if some positional shift occurs therein since the display information is a letter indicator or the like, and so on, whereby electric power consumption is suppressed, and a size increase is suppressed.

However, in the conventional configuration related to the detection of the hand positions, it is determined by mistake that the hands are located at normal positions even in a situation where the hands are left stopped at positions where position confirmation of the hands is performed. Hence, in an analog electronic timepiece having a configuration in which a hand provided with no position detecting mechanism rotates in conjunction with a hand provided with a position detecting mechanism, there is a case where a long time elapses without perceiving that the operations of the hands are stopped, and a correct position of the hand provided with no position detecting mechanism is lost.

The present invention provides an analog electronic timepiece capable of returning the hand, which rotates in conjunction, to the correct position with ease after the operation thereof is resumed even in the case where the hand does not operate normally for a long time.

SUMMARY OF THE INVENTION

According to one aspect of the present invention, there is provided an analog electronic timepiece including: a plurality of rotating display bodies which indicate a current time and date in such a manner that display modes corresponding to rotation operations thereof are combined with one another; a gear train mechanism in which a plurality of gears are arrayed, the plurality of gears rotating a second rotating display body among the plurality of rotating display bodies by a predetermined angle in conjunction with a rotation of a first rotating display body among the plurality of rotating display bodies every time the first rotating display body makes one rotation; a drive control unit which performs drive control for a rotation operation of the gear train mechanism; a detection unit which detects whether or not the first rotating display body is in a predetermined reference display mode; and a delay cycle counting unit which counts a number of delay cycles, the number indicating a rotation delay amount of the display mode of the first rotating display body, wherein the delay cycle counting unit adds 1 to the number of delay cycles in a case where it is determined, for each detection cycle of the predetermined reference display mode, that the first rotating display body is stopped during a rotation cycle of the first rotating display body based on detection results by the detection unit at a first timing when the detection unit is scheduled to detect that the first rotating display body is in the predetermined reference display mode and at a second timing different from the first timing, and the drive control unit rotationally moves the first rotating display body for a number of times, the number corresponding to the number of delay cycles, in a case where the first rotating display body is capable of operating at the first timing.

BRIEF DESCRIPTION OF THE DRAWINGS

The above and other objects, advantages and features of the present invention will become more fully understood from the detailed description given hereinafter and the appended drawings which are given byway of illustration only, and thus are not intended as a definition of the limits of the present invention, and wherein.

DETAILED DESCRIPTION OF THE PREFERRED EMBODIMENT

Hereinafter, embodiments of the present invention will be described on the basis of the drawings.

Figure 1:
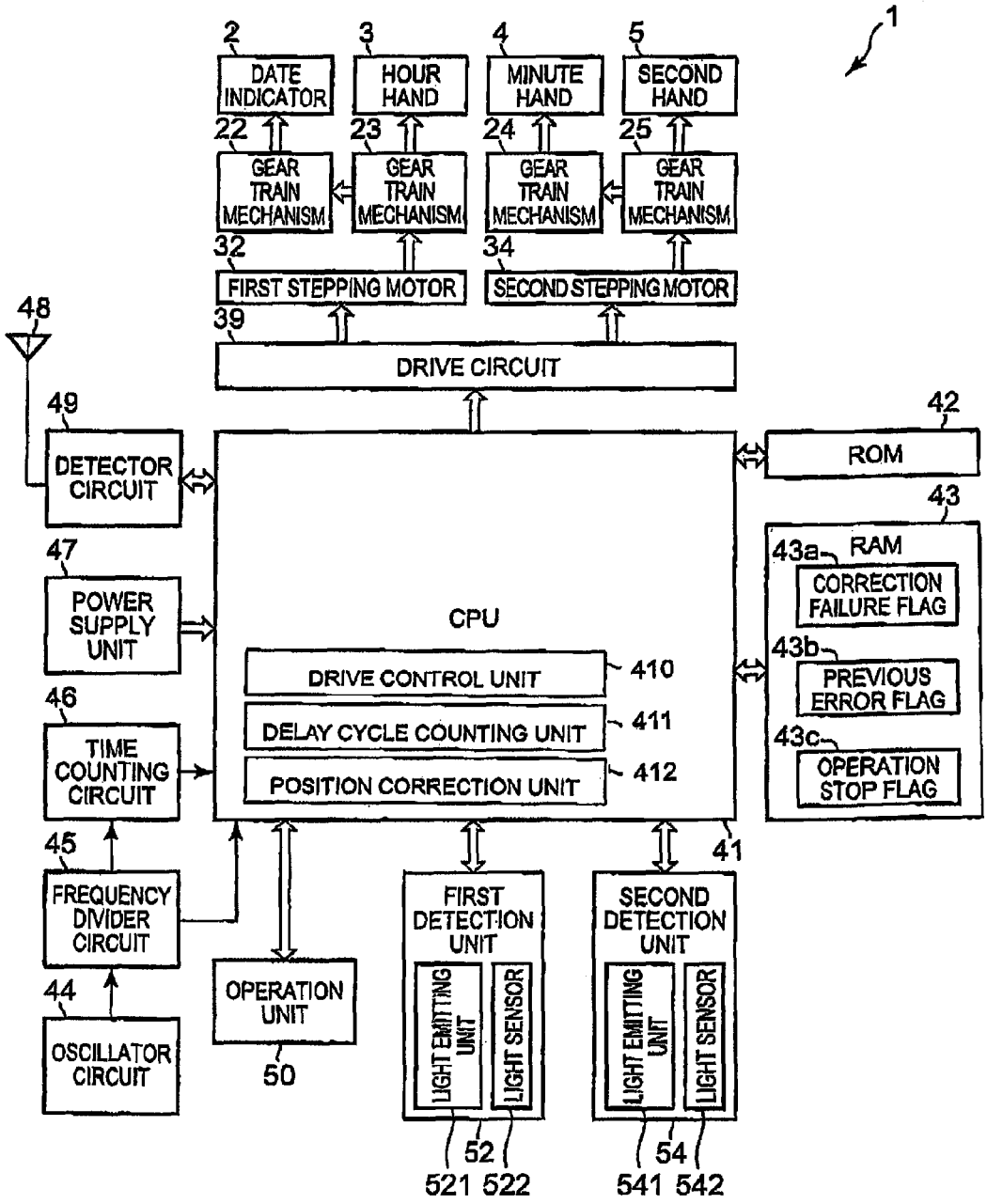
FIG. 1 is a block diagram showing an internal configuration of an analog electronic timepiece of an embodiment of the present invention.

FIG. 1 is a block diagram showing an internal configuration of an analog electronic timepiece of an embodiment of the present invention.

An analog electronic timepiece 1 of this embodiment includes: a date indicator 2 (second rotating display body), an hour hand 3 (first rotating display body), a minute hand 4, and a second hand 5 (hereinafter, the day indicator 2 to the second hand 5 are also written as hands 2 to 5 (rotating display bodies) in a lump); a first stepping motor 32 that rotationally operates the date indicator 2 through a gear train mechanism 22 in which a plurality of gears are arrayed, and in addition, rotationally operates the hour hand 3 through a gear train mechanism 23; a second stepping motor 34 that rotationally operates the minute hand 4 through a gear train mechanism 24, and in addition, rotationally operates the second hand 5 through a gear train mechanism 25; a drive circuit 39 that outputs a drive pulse to the first stepping motor 32 and the second stepping motor 34; a CPU (central processing unit) 41 (which includes drive control unit 410, delay cycle counting unit 411, and position correction unit 412); a ROM (read only memory) 42; a RAM (random access memory) 43; an oscillator circuit 44; a frequency divider circuit 45; a time counting circuit 46; a power supply unit 47; a detector circuit 49 that demodulates a signal from a radio wave received by using an antenna 48; an operation unit 50 (operation unit); a first detection unit 52 (detection unit); a second detection unit 54; and the like.

Each of the hour hand 3, the minute hand 4 and the second hand 5 is a hand that has a usual shape of a hand. The hour hand 3, the minute hand 4 and the second hand 5 are arranged so as to be rotatable about the same rotation axis on a dial, and each indicates one direction. The hour hand 3, the minute hand 4 and the second hand 5 can be formed with arbitrary thicknesses into arbitrary decorative shapes within a range where the indicated directions are easily readable. Meanwhile, the date indicator 2 is an annular (disc-shaped) hand, and is arranged under the dial so as to be rotatable about the above-described rotation axis. On an upper surface of the date indicator 2, date marks which individually indicate dates "1" to "31" are sequentially provided on a peripheral edge portion thereof. By rotating the date indicator 2, any one date mark is selectively exposed from a transparent small window (window portion) provided on the dial. This transparent small window may be covered with a transparent member such as glass and acrylic resin.

In the analog electronic timepiece 1 of this embodiment, the first stepping motor 32 is driven by a drive pulse inputted once per minute from the drive circuit 39, and a rotor thereof rotationally operates by 180 degrees to thereby rotate the hour hand 3. In addition, only during a predetermined period in one day, for example, only for 150 minutes from 22:30 to 1:00, the first stepping motor 32 rotates the date indicator 2 in conjunction with such rotation of the hour hand 3, and advances the date mark by one day. The second stepping motor 34 is driven by a drive pulse inputted every second from the drive circuit 39, and a rotor thereof rotationally operates by 180 degrees to thereby rotate the second hand 5 and the minute hand 4 individually at predetermined angles in conjunction with each other. Moreover, the first detection unit 52 detects a state where the hour hand 3 is located at a predetermined position. The second detection unit 54 detects a state where all of the hour hand 3, the minute hand 4 and the second hand 5 are located at predetermined positions. A description will be made later in detail of structures of the gear train mechanisms 22 to 25 and operations related to such position detection of the hands 2 to 5 by the first detection unit 52 and the second detection unit 54.

The CPU 41 performs a variety of arithmetic operation processing in the analog electronic timepiece 1, and in addition, performs integrated control for the entire operations. The ROM 42 memorizes a control program of the analog electronic timepiece 1, which is executed by the CPU 41, and operation programs related to a variety of functions. The RAM 43 is a volatile memory, which provides the CPU 41 with a memory space for work, is loaded with a program read out from the ROM 42, and memorizes temporal data and the like. Moreover, the RAM 43 memorizes a variety of flags related to such rotation operations of the hands, for example, a correction failure flag 43*a*, a previous error flag 43*b*, and an operation stop flag 43*c* (number of delay cycles).

Here, in the analog electronic timepiece 1 of this embodiment, the previous error flag 43*b* is binary data, which is "1" in a set state thereof, and is "0" in a reset state (non-set state) thereof. Meanwhile, each of the correction failure flag 43*a* and the operation stop flag 43*c* can be made as multi-level data, which is set at an integer of "1" or more in a set state thereof, and is set at "0" in a reset state thereof. A maximum value in the set state is set as appropriate according to a memory capacity of the RAM 43, and the like.

The oscillator circuit 44 oscillates and outputs a predetermined frequency signal. The frequency divider circuit 45 divides the frequency signal inputted from the oscillator circuit 44, and generates and outputs signals of the respective frequencies, which are used in the analog electronic timepiece 1. The time counting circuit 46 counts the number of input times of such a signal of a predetermined frequency (for example, 1 Hz), which is outputted from the frequency divider circuit 45, sequentially adds the counted number of input times to time data, and thereby holds a current time.

The power supply unit 47 supplies electric power through the CPU 41 to the respective units of the analog electronic timepiece 1. This power supply unit 47 is not particularly limited; however, for example, is a unit made capable of supplying electric power continuously for a long period by combining a solar cell and a secondary battery.

The antenna 48 and the detector circuit 49 form a circuit that receives a standard wave, which encodes and transmits time information by a radio wave of the long wave band, and demodulates an encoded signal (time code). The demodulated time code is decoded and decrypted by the CPU 41, whereby the time data is obtained. Moreover, accurate current time data based on this time data is sent from the CPU 41 to the time counting circuit 46, and previous time data is overwritten and corrected thereby.

The operation unit 50 includes external operation switches, such as a push button, a crown and the like, for example, receives an operation such as depression and rotation by a user, converts the operation into an electrical signal, and outputs the electrical signal to the CPU 41. In this operation unit 50 and the CPU 41, when a fast-forwarding operation for the hour hand 3 and the date indicator 2 is performed after mode setting for date adjustment is performed, it is made possible to fast-forward the hour hand 3 and the date indicator 2 in a lump by every 12 hours, that is, by every one rotation (720 steps, a predetermined number of steps) of the hour hand 3.

Next, a description is made of the structures of the gear train mechanisms 22 to 25 and the position detection of the hands 2 to 5.

FIGS. 2A to 2D are plan views showing the structures of the gear train mechanisms 22 to 25 of the analog electronic timepiece 1 of this embodiment. Note that, in the respective drawings, a position of a rotation axis R common to the hands 2 to 5 is displayed being shifted in a longitudinal direction.

Figures 2A, 2B, 2C, 2D:
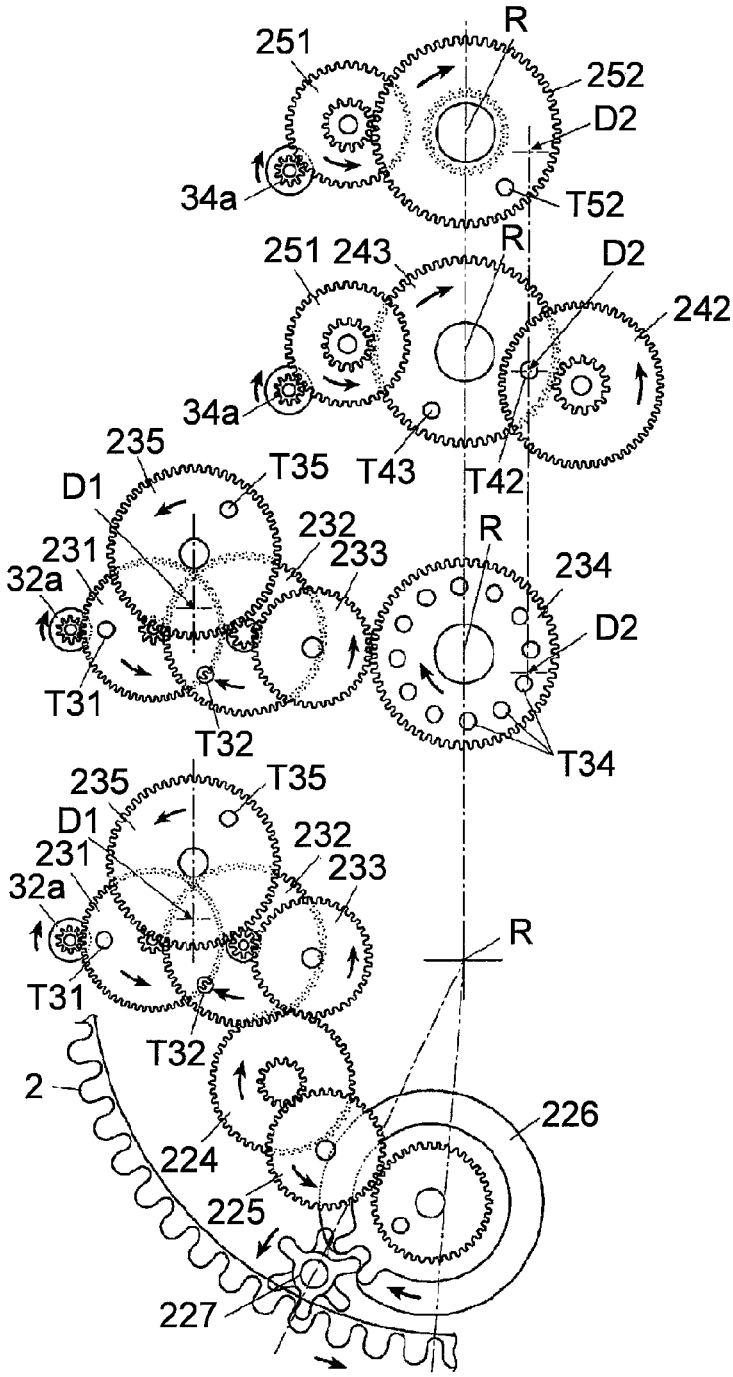
FIGS. 2A to 2D are plan views showing a structure of gear train mechanisms that operate respective hands.

As shown in FIG. 2A, rotation of a rotor 34*a* of the second stepping motor 34 is transmitted to the second hand 5 through a fifth wheel 251 and a second hand wheel 252 (fourth wheel), which compose the gear train mechanism 25, and the second hand 5 rotates by six degrees at timing of a head of every second together with the second hand wheel 252. Then, the second hand 5 rotates by 360 degrees for 60 seconds. One transparent hole T52 is provided in the second hand wheel 252.

Meanwhile, rotation operations of the fifth wheel 251 and the second hand wheel 252 are also transmitted to the gear train mechanism 24. In FIG. 2B, the second hand wheel 252 (not shown; refer to FIG. 2A), which is arranged so that a rotation axis thereof can be the same as the rotation axis R of a minute hand wheel 243 (center wheel), rotates the minute hand wheel 243 (center wheel) in conjunction therewith through a third wheel 242. The minute hand 4 rotates by 0.1 degree every second together with this minute hand wheel 243, and makes one rotation for 3600 seconds, that is, 60 minutes. In the third wheel 242, one transparent hole T42 is provided, and moreover, in the minute hand wheel 243, one transparent hole T43 is provided.

Next, as shown in FIG. 2C, rotation of a rotor 32*a* of the first stepping motor 32 is transmitted to an hour hand wheel 234 through intermediate wheels 231, 232 and 233 which compose the gear train mechanism 23. The hour hand wheel 234 is arranged so as to rotate about the same rotation axis R as that of the second hand wheel 252 and the minute hand wheel 243, and the hour hand 3 rotates by 0.5 degree at timing of zero second of every minute together with the hour hand wheel 234. Then, the hour hand 3 makes one rotation over the dial during 720 minutes (12 hours, rotation cycle). Moreover, the gear train mechanism 23 has a configuration in which a detection wheel 235 rotates in meshing with the intermediate wheel 233. In a similar way to the hour hand wheel 234, the detection wheel 235 rotates by 0.5 degree at timing of zero second of every minute.

In the intermediate wheels 231 and 232 and the detection wheel 235, transparent holes T31, T32 and T35 are provided, respectively. Moreover, in the hour hand wheel 234, twelve transparent holes T34 are provided at intervals of 30 degrees.

Moreover, as shown in FIG. 2D, such rotation of the intermediate wheel 233 is transmitted not only to the hour hand wheel 234 but also to an intermediate wheel 224 that composes the gear train mechanism 22. Rotation of the intermediate wheel 224 is further transmitted to the date indicator 2 through an intermediate wheel 225, an intermediate date wheel 226 and date indicator driving wheel 227. The intermediate date wheel 226 rotates by 0.25 degree at timing of zero second of every minute, and makes one rotation for 24 hours (predetermined cycle). On this intermediate date wheel 226, teeth which mesh with teeth of the date indicator driving wheel 227 only within a predetermined angle range (angular width is 37.5 degrees) are provided separately, and in a time band when the intermediate date wheel 226 is located in the angle range concerned (22:30 to 1:00, predetermined period), the date indicator driving wheel 227 is rotated in conjunction with a rotation operation of the intermediate date wheel 226. This date indicator driving wheel 227 is meshed with an internal gear of the date indicator 2, and the date indicator driving wheel 227 rotates, whereby the date indicator 2 rotates by 11.25 degrees (predetermined angle), and the date marks provided on a front side of the date indicator 2 move by an amount of one day.

Next, a description is made of position detection operations for the hands 2 to 5.

As shown in FIGS. 2C and 2D, at a position D1, the first detection unit 52 is provided. The first detection unit 52 includes a light emitting unit 521 and a light sensor 522. The position D1 is a position where the intermediate wheels 231 and 232 and the detection wheel 235 overlap one another. Then, in the analog electronic timepiece 1 of this embodiment, all of the transparent hole T31 of the intermediate wheel 231, the transparent hole T32 of the intermediate wheel 232 and the transparent hole T35 of the detection wheel 235 are arranged so as to overlap one another at the position D1 during the one minute that begins from each of 11:55:00 and 23:55:00 (first timing).

At the position D1, light, which is emitted downward from above rotation surfaces of the respective gears of the gear train mechanism 23 by the light emitting unit 521, passes through the transparent holes T31, T32 and T35 (detection target portions) of the intermediate wheels 231 and 232 and the detection wheel 235 (predetermined wheels) only in the case where all of these transparent holes overlap one another at the position D1, and then the light concerned is detected by the light sensor 522 provided below the rotation surface. That is to say, in the analog electronic timepiece 1 of this embodiment, it is made possible to perform detection as to whether or not the hour hand 3 is located at a correct position (predetermined reference display mode) once every 12 hours (detection cycle).

Moreover, as shown in FIGS. 2A, 2B and 2C, at a position D2, the second detection unit 54 is provided. The second detection unit 54 includes a light emitting unit 541 and a light sensor 542. The position D2 is a position where the transparent holes T52, T42, T43 and T34 overlap one another, the position being located on a line segment that connects the rotation axis R of the second hand wheel 252, the minute hand wheel 243 and the hour hand wheel 234 and a rotation axis of the third wheel 242 to each other. That is to say, all of the transparent holes T52, T43 and T34 are arranged on circumferences which have the same rotation radius. Here, the transparent holes T52, T42, T43 and T34 are arranged so as to overlap one another at the position D2 at 55 minutes zero second every hour. In the analog electronic timepiece 1 of this embodiment, a configuration is adopted so as to be capable of determining whether or not all of the transparent holes T52, T42, T43 and T34 overlap one another at the position D2 at an interval of an hour based on whether or not, at the position D2, light which is emitted downward from above the second hand wheel 252, the minute hand wheel 243 and the hour hand wheel 234 by the light emitting unit 541, passes through the transparent holes, and is detected by the light sensor 542 provided therebelow.

Here, in the analog electronic timepiece 1 of this embodiment, sizes of the transparent holes T52, T42, T43, T31, T32, T34 and T35 are equal to one another. Moreover, angular widths in a rotation direction of these transparent holes T52, T42, T43, T31, T32, T34 and T35 are six degrees or less.

In the analog electronic timepiece 1 of this embodiment, the minute hand 4 that rotates in conjunction with the second hand 5 rotates by 0.1 degree every second. Hence, when the transparent hole T52 returns to the same position (position D2) by the second hand 5 making one rotation, the minute hand 4 has rotated by six degrees corresponding to 60 steps, and the transparent hole T43 already has been deviated from the position D2. A rotation cycle of the third wheel 242 and the transparent hole T42 is set at a submultiple of 60 minutes since the transparent hole T42 must be located at the position D2 simultaneously with the event where the transparent hole T43 returns to the position D2 in a cycle of 60 minutes.

In a similar way, the hour hand 3 rotates by 0.5 degree every minute, and accordingly, the detection wheel 235 also rotates by 0.5 degree every minute. Hence, in the case where the width of the transparent hole T35 in the rotation direction is six degrees, the transparent hole T35 gradually moves to a position of overlapping the transparent hole located at the position D1 for 12 minutes, and thereafter, the transparent hole T35 is deviated from the position of overlapping the transparent hole located at the position D1 for another 12 minutes. Hence, both of rotation cycles of the intermediate wheels 231 and 232 must be 12 minutes or more, that is, rotation angles thereof per step will be set at 30 degrees or less. Moreover, at the same time, in at least either of the intermediate wheels 231 and 232, a rotation angle thereof per step must be six degrees or more. Furthermore, both of the transparent holes T31 and T32 must overlap the position D1 after the elapse of 12 hours. Hence, the rotation angles per step of the intermediate wheels 231 and 232 are integral multiple values of 0.5 degree. As a configuration that satisfies the above-described conditions, here, for example, the rotation angles per step of the intermediate wheels 231 and 232 are set at 30 degrees (12 minutes per rotation) and four degrees (90 minutes per rotation), respectively.

Next, a description is made of operation detection processing for the date indicator 2 in the analog electronic timepiece 1 of this embodiment.

Figure 3:
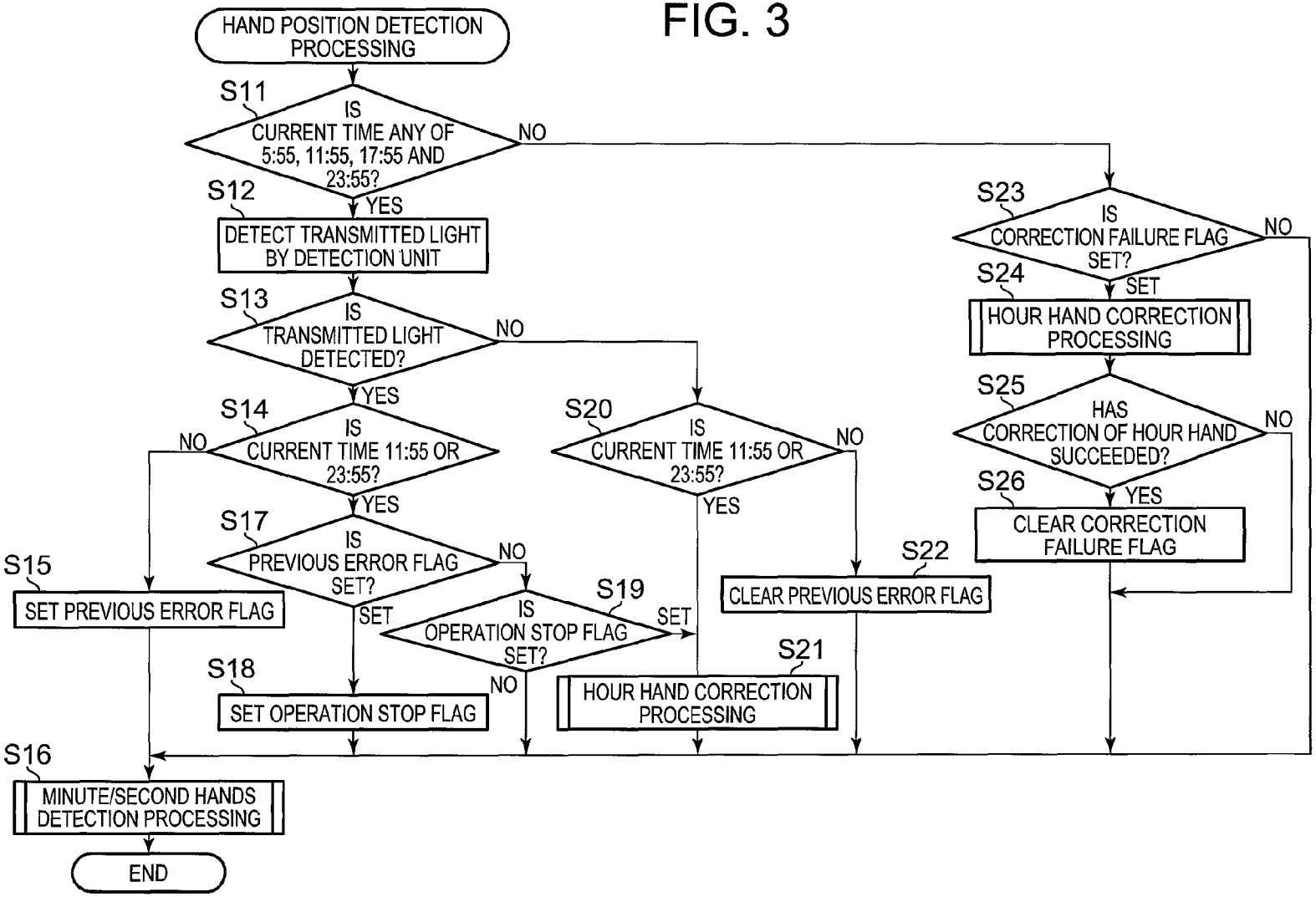
FIG. 3 is a flowchart showing a control procedure of hand position detection processing.

FIG. 3 is a flowchart showing a control procedure of hand operation detection processing which the CPU 41 executes in the analog electronic timepiece 1 of this embodiment.

This hand operation detection processing is processing automatically invoked and executed once at a predetermined time of every hour. As this predetermined time, timing when the minute hand wheel 243 and the second hand wheel 252 overlap each other at the position D2 is set. That is to say, in this embodiment, the hand operation detection processing is invoked and executed at 55 minutes zero second every hour.

When the hand operation detection processing is started, the CPU 41 determines whether or not the current time is any of 5:55, 11:55, 17:55 and 23:55 (Step S11). In the case where it is determined that the current time is any time of these, the CPU 41 subsequently operates the first detection unit 52 to detect emitted light (transmitted light), which comes from the light emitting unit 521 and is transmitted through the transparent holes, by the light sensor 522 (Step S12). Then, the CPU 41 determines whether or not this light is detected by the first detection unit 52 (Step S13).

In the case where it is determined that the light is detected by the first detection unit ("YES" in the determination processing of Step S13), the CPU 41 subsequently determines whether or not the current time is 11:55 or 23:55 (Step S14). In the case where it is determined that the current time is not either time of these, that is, the current time is 5:55 or 17:55 (second timing) ("NO" in Step S14), this indicates that the light is detected at an incorrect time, and accordingly, the CPU 41 sets the previous error flag 43*b* (Step S15), and then shifts the processing to Step S16.

In the case where it is determined that the current time is either 11:55 or 23:55 ("YES" in Step S14), the CPU 41 subsequently determines whether or not the previous error flag 43*b* is set (Step S17). In the case where it is determined that the previous error flag 43*b* is set, the CPU 41 sets (adds 1 to) the operation stop flag 43*c* (Step S18), and subsequently, shifts the processing to Step S16. Meanwhile, in the case where it is determined that the previous error flag 43*b* is not set, the CPU 41 further determines whether or not the operation stop flag 43*c* is set (is one or more) (Step S19). In the case where it is determined that the operation stop flag 43*c* is not set, the processing of the CPU 41 directly proceeds to Step S16. In the case where it is determined that the operation stop flag 43*c* is set, the processing of the CPU 41 proceeds to Step S21.

In the case where it is determined that the light is not detected by the first detection unit 52 ("NO" in the determination processing of Step S13), the CPU 41 subsequently determines whether or not the current time is 11:55 or 23:55 (Step S20). In the case where it is determined that the current time is either time of these ("YES" in Step S20), the CPU 41 executes hour hand correction processing to be described later (Step S21), and then shifts the processing to Step S16. Meanwhile, in the case where it is determined that the current time is not either time of these ("NO" in Step S20), the CPU 41 clears the previous error flag 43*b* (Step S22), and then shifts the processing to Step S16.

In the case where it is determined that the current time is not any time of the above-described ones, that is, the current time is 55 minutes past other than five o'clock, 11 o'clock, 17 o'clock and 23 o'clock in the determination processing of Step S11, the CPU 41 determines whether or not the correction failure flag 43*a* is set (is one or more) (Step S23). In the case where it is determined that the correction failure flag 43*a* is set, the CPU 41 performs the hour hand correction processing (Step S24), and then determines whether or not the correction of the hour hand position has succeeded (Step S25). In the case where it is determined that the correction of the hour hand has succeeded ("YES" in Step S25), the CPU 41 clears the correction failure flag 43*a* (Step 26), and thereafter, shifts the processing to Step S16, and in the case where it is determined that the correction of the hour hand has not succeeded ("NO" in Step S25), the CPU 41 directly shifts the process to Step S16. In the case where it is determined that the correction failure flag 43*a* is not set in the determination processing of Step S23, the CPU 41 directly shifts the processing to Step S16.

When the processing proceeds to processing of Step S16, the CPU 41 executes minute/second hands detection processing, and thereafter, ends the hand position detection processing.

Figure 4:
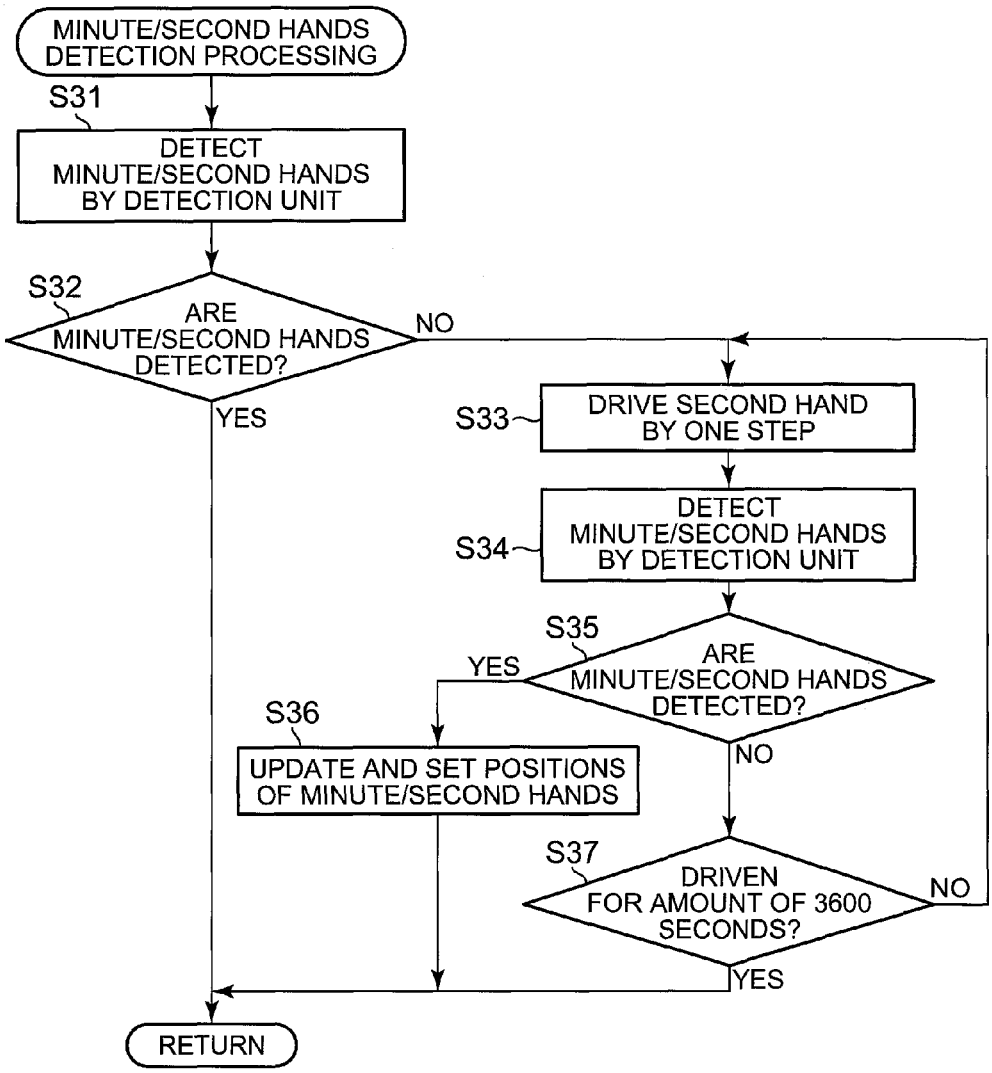
FIG. 4 is a flowchart showing a control procedure of minute/second hands detection processing invoked in the hand position detection processing.

FIG. 4 is a flowchart showing a control procedure by the CPU 41 in the minute/second hands detection processing invoked in Step S16 of the hand position detection processing.

When the minute/second hands detection processing is invoked, the CPU 41 first operates the second detection unit 54 to detect light which is emitted from the light emitting unit 541 and is transmitted through the transparent holes, by the light sensor 542, and thereby detects normal arrangement of the minute hand 4 and the second hand 5 (Step S31). Next, the CPU 41 determines whether or not the light sensor 542 has detected this light (Step S32). In the case where it is determined that the light sensor 542 has detected the light ("YES" in Step S32), the CPU 41 determines that the minute/second hands are located at normal positions, ends the minute/second hands detection processing without doing anything else, and returns to the hand position detection processing.

In the case where it is determined that the light sensor 542 has not detected the light ("NO" in Step S32), the CPU 41 outputs a control signal to the drive circuit 39, and allows the drive circuit 39 to move the second hand 5 by one step (Step S33). Thereafter, the CPU 41 allows the second detection unit 54 to perform such light emitting and detection operations one more time (Step S34), and determines whether or not the light sensor 542 has detected the light (Step S35). In the case where it is determined that the light is detected ("YES" in Step S35), the CPU 41 sets the positions after the movement as current positions of the minute hand 4 and the second hand 5 (Step S36). Then, the CPU 41 leaves the minute/second hands detection processing, and returns the processing to the hand position detection processing.

In the case where it is determined that the light is not detected, that is, at least one of the minute hand 4 and the second hand 5 is not in the normal arrangement in the determination processing of Step S35 ("NO" in Step S35), the CPU 41 determines whether or not the control signal has been outputted 3600 times to the drive circuit 39 and the operations of the minute hand 4 and the second hand 5 have been attempted for an amount of 3600 seconds, that is, for an amount of one rotation of the minute hand 4 (Step S37). In the case where it is determined that the control signal is not outputted 3600 times ("NO" in Step S37), the processing of the CPU 41 returns to Step S33, and the processing of Steps S33 to S35 is repeated.

In the case where it is determined that the control signal is outputted 3600 times ("YES" in Step S37), it is assumed that, in the hand position detection processing, the hour hand wheel 234 is stopped while being left shifted from the position thereof at 55 minutes every hour, or the rotor 34*a* of the second stepping motor 34 does not rotationally operate in accordance with the control signal. Accordingly, the CPU 41 erroneously ends the minute/second hands detection processing without doing anything else, and returns to the hand position detection processing. In this case, in a similar way to the correction failure flag 43*a*, the CPU 41 can set in advance a flag or a parameter which indicates that the correction of the minute hand 4 and the second hand 5 has failed.

Figure 5:
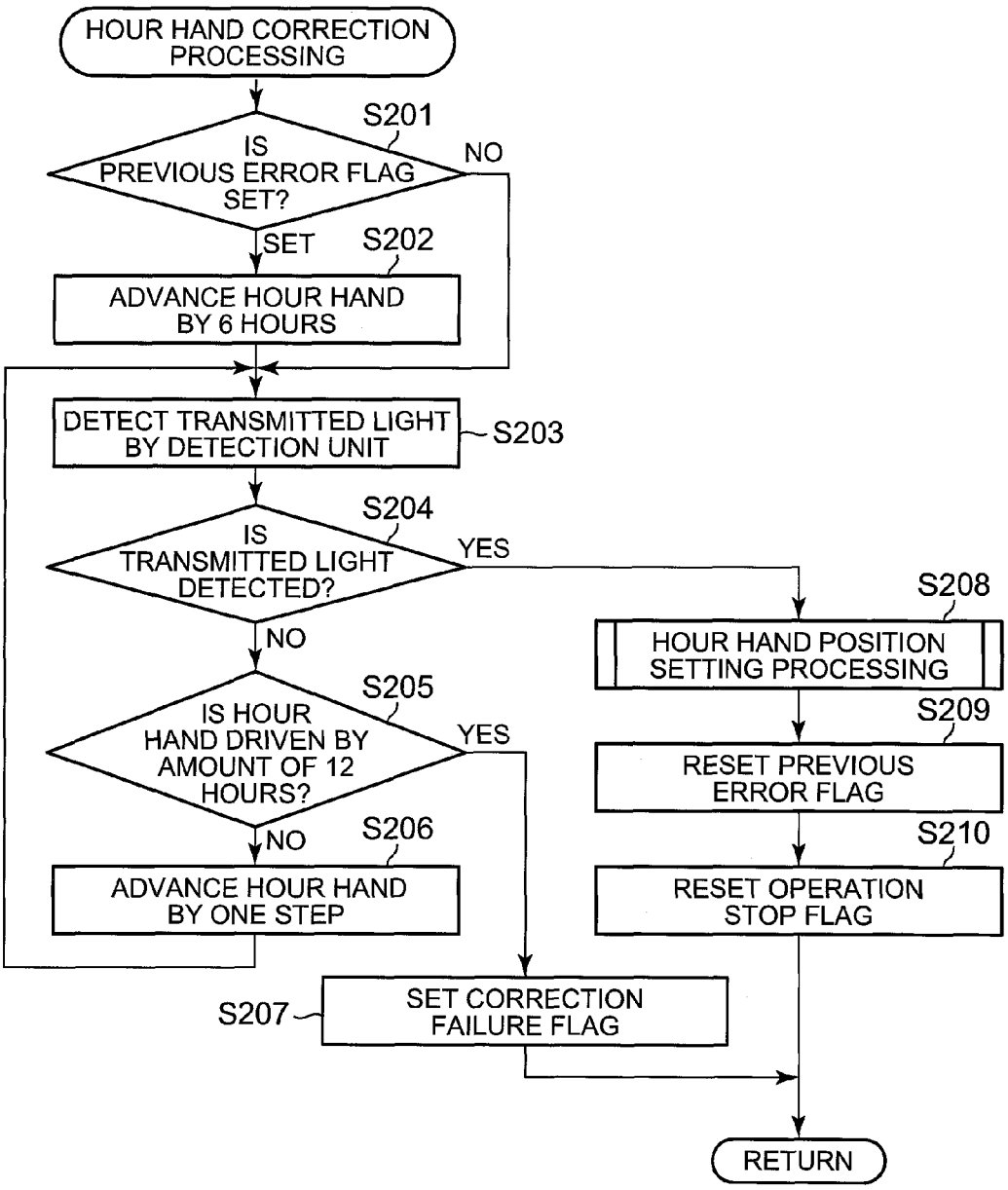
FIG. 5 is a flowchart showing a control procedure of hour hand correction processing invoked in the hand position detection processing.

FIG. 5 is a flowchart showing a control procedure of hour hand correction processing invoked in the hand position detection processing.

When the processing of the CPU 41 proceeds to Step S21 or Step S24 and the hour hand correction processing is invoked in the hand position detection processing, the CPU 41 determines whether or not the previous error flag 43*b* is set (Step S201). In the case where it is determined that the previous error flag 43*b* is set, then this indicates that the hour hand 3 had not moved for at least six hours from when such a hand position detection operation was performed 12 hours before until when the hand position detection operation was performed six hours before. Accordingly, the CPU 41 sends the control signal to the drive circuit 39, and allows the drive circuit 39 to advance the hour hand 3 by an amount of six hours (here, 360 steps) (Step S202). Thereafter, the CPU 41 shifts the processing to Step S203. Meanwhile, in the case where it is determined that the previous error flag 43*b* is not set, the processing of the CPU 41 directly proceeds to Step S203.

When the processing of the CPU 41 proceeds to the processing of Step S203, the CPU 41 operates the first detection unit 52 to perform an operation of detecting the light which is emitted from the light emitting unit 521, by the light sensor 522. Then, the CPU 41 determines whether or not the light is detected by the light sensor 522, that is, whether or not all of the transparent holes T31, T32 and T35 overlap one another at the position D1 (Step S204). In the case where it is determined that the light is not detected ("NO" in Step S204), then next, the CPU 41 determines whether or not there has already been performed processing for outputting, 720 times, the control signal for driving the first stepping motor 32 and moving the hour hand 3 by an amount of 12 hours (720 steps, one rotation) (Step S205). In the case where it is determined that the control signal for moving the hour hand 3 by an amount of 12 hours is not outputted yet ("NO" in Step S205), the CPU 41 outputs a control signal for advancing the hour hand 3 by one step to the drive circuit 39 (Step S206), and then returns the processing of the CPU 41 to Step S203.

In the case where it is determined that there has already been performed the processing for outputting, 720 times, the control signal for driving the first stepping motor 32 and moving the hour hand 3 by an amount of 12 hours (720 steps) in the determination processing of Step S205 ("YES" in Step S205), then the CPU 41 sets (adds 1 to) the correction failure flag 43*a* (Step S207), ends the hour hand correction processing, and returns to the hand position detection processing. To such a case, a case of a state applies, where the rotor 32*a* of the first stepping motor 32 does not rotate normally even if the control signal is sent thereto owing to an external magnetic field and the like.

Meanwhile, in the case where it is determined that the light transmitted through the transparent holes is detected in the determination processing of Step S204 ("YES" in Step S204), the CPU 41 invokes and executes hour hand position setting processing (Step S208), and then performs a reset operation of the previous error flag (Step S209) and a reset operation of the operation stop flag (Step S210). Then, the CPU 41 ends the hour hand correction processing, and returns to the hand position detection processing.

Figure 6:
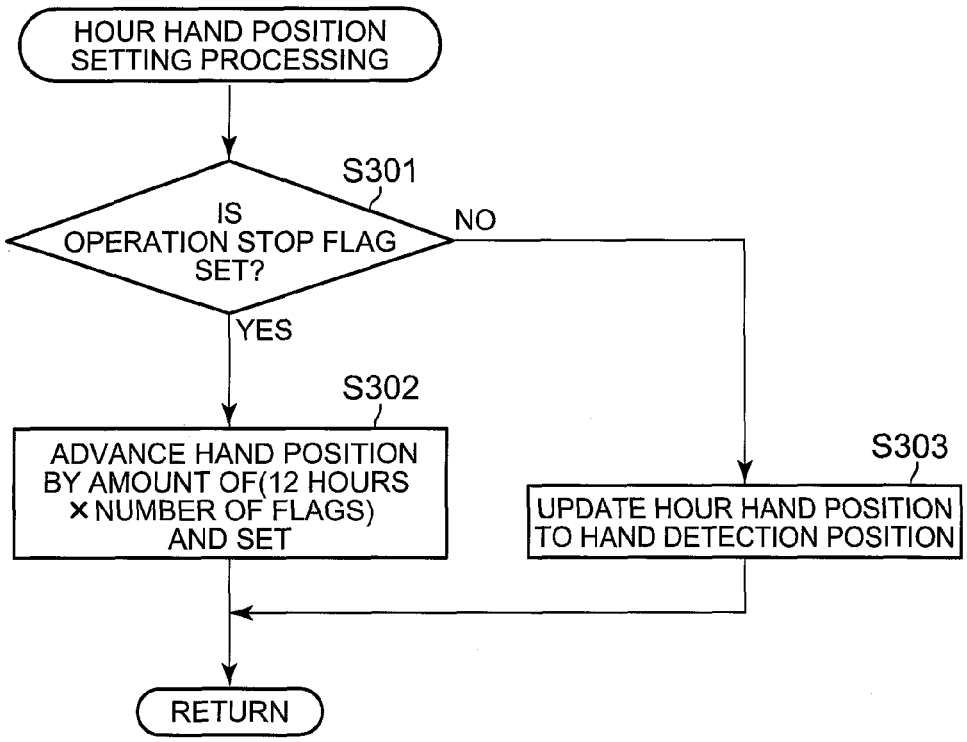
FIG. 6 is a flowchart showing a control procedure of hour hand position setting processing invoked in the hour hand correction processing.

FIG. 6 is a flowchart showing a control procedure by the CPU 41 in the hour hand position setting processing invoked in the hour hand correction processing.

When the hour hand position setting processing is invoked, the CPU 41 determines whether or not the operation stop flag 43*c* is set (Step S301). In the case where it is determined that the operation stop flag 43*c* is not set ("NO" in Step S301), then it can be determined that the time while the hour hand 3 is being stopped is less than 12 hours, and accordingly, the CPU 41 updates setting of hour hand position data on the RAM 43 to a position corresponding to the detected time (that is, 11:55 or 23:55) (Step S303). Then, the CPU 41 ends the hour hand position setting processing, and returns to the hour hand correction processing.

Meanwhile, in the case where it is determined that the operation stop flag 43*c* is set ("YES" in Step S301), it can be determined that the hour hand 3 has stopped for 12 hours or more. Moreover, if the operation stop flag 43*c* is made as multi-level data, then the operation stop flag 43*c* is added with 1 every 12 hours. That is to say, a current position of the hour hand 3 and a current position of the date indicator 2 are delayed by a time obtained by multiplying a value of the operation stop flag 43*c* by 12. Hence, the CPU 41 outputs a control signal for driving the first stepping motor 32 to the drive circuit 39 so as to advance the hour hand 3 by an amount of the time concerned (Step S302). By this operation, the hour hand 3 rotates by the number of times, which is the same as the value of the operation stop flag 43*c*, and returns to the same position; and, a shift of setting of morning/afternoon and the date, that is, the position of the date indicator 2 is corrected. When the update of the position data of the hour hand 3 is ended, the CPU 41 ends the hour hand position setting processing, and returns to the hour hand correction processing.

Here, in this hour hand position setting processing, it can be assumed that the delay of 12 hours has occurred at the position of the hour hand 3 also in the case where the value of the correction failure flag 43*a* has become "12" or more. Hence, the CPU 41 rotates the hour hand 3 forward by an amount of a time obtained by multiplying, by 12 hours, the number of times of a quotient obtained by dividing this correction failure flag 43*a* by 12, and can thereby adjust the date.

In the hand position detection processing, in the case where it is determined that the hour hand 3 or the minute hand 4 and the second hand 5 are not located at the correct positions, and the position detection for these minute hand 4 and second hand 5 is performed, then there can be a case where a detection operation of these is not ended within one second. Hence, it is necessary for the CPU 41 to suspend control processing, which is related to a regular hand drive operation following a change of a current time, at the time when the detection operation is started. Meanwhile, in the event where this detection operation is ended, a time lag occurs between the detected time and the current time. Hence, it is necessary for the CPU 41 to perform processing for adjusting the display time to be correct at the end of the hand position detection processing.

Note that the correction processing for the shift in the unit of 12 hours, which is performed in the processing of Step S302 described above and the like can also be performed in a lump in the event of this final time adjustment processing.

As described above, the analog electronic timepiece 1 of this embodiment includes: the hour hand 3; the date indicator 2; the gear train mechanisms 22 and 23 configured to rotate the date indicator 2 in conjunction with the rotation of the hour hand 3; the CPU 41 which outputs the control signals to the drive circuit 39, thereby drives the first stepping motor 32, and controls the rotation of the gear train mechanisms 22 and 23 at appropriate timing; and the first detection unit 52 that detects the rotation position of the hour hand 3. Then, once every 12 hours, the first detection unit 52 is operated at 11:55 a.m./p.m., each of which is the time when the transparent holes T31, T32 and T35 provided in the gear train mechanism 23 are to overlap one another at the position D1, and at 5:55 a.m./p.m., each of which is the time when these transparent holes are not to overlap one another at the position D1, whereby it is determined whether or not the hour hand 3 rotates normally. If the transparent holes T31, T32 and T35 are detected in both cases, it is determined that the operation of the hour hand 3 is stopped for 12 hours (one cycle of the hour hand 3) while these transparent holes T31, T32 and T35 keep on overlapping one another at the position D1, and 1 is added to the operation stop flag 43*c*. Thereafter, in the case where the transparent holes T31, T32 and T35 come not to be detected, and it is determined that the rotation operation of the hour hand 3 is resumed, then the hour hand 3 is rotated by the amount of the number of cycles, which is memorized as the operation stop flag 43*c*. By the operations as described above, it is possible to acquire the long-period stopped state of the hour hand 3 at the position of 11:55 a.m./p.m., which has not been able to be acquired by the conventional configuration of detecting that the hour hand 3 is located at the normal position at a predetermined time. Then, the shift of the display position of the date indicator 2, which follows the delay of the rotation of the hour hand 3, can be corrected without directly performing the position detection of the date indicator 2.

Moreover, the detection processing as described above is performed twice at the detection timing and the non-detection timing with respect to the detection cycle, whereby the state where the hour hand 3 is stopped at the position of 11:55 a.m./p.m. can be acquired efficiently.

Moreover, while the date indicator 2 which rotates periodically only during the predetermined period in conjunction with the rotation of the hour hand 3 is a rotation plate that requires a large number of steps for one rotation thereof, the position of the date indicator 2 can be acquired in a short time without directly detecting the position of the rotation plate.

Moreover, in particular, the configuration and the processing, which are as described above, are applied to the analog electronic timepiece in which the hour hand 3 and the date indicator 2 are operated in conjunction with each other, whereby the hand positions can be prevented from being erroneously set and memorized in the RAM 43.

Moreover, in the case of the combination of the date indicator 2 and the hour hand 3, which is as described above, the detection wheel 235, which is made capable of detecting the hour hand 3 in the same cycle as that of the hour hand wheel 234 that makes one rotation during 12 hours, is combined therewith, and it is made possible to detect the hand position at the predetermined time once every 12 hours, whereby the time position including information about the morning/afternoon can be acquired while coping with the date shift with ease.

Moreover, even in the case of using such a configuration like the data indicator 2, in which torque required for the rotation operation is large, as the date display, and exposing and displaying the date mark from the small window, the date information can be accurately maintained with ease by applying the present invention.

Moreover, the first detection unit 52 includes the light emitting unit 521 and the light sensor 522, and is configured to detect whether or not the transparent holes T31, T32 and T35 overlap one another at the position D1 in such a manner that the light emitted from the light emitting unit 521 penetrates these transparent holes T31, T32 and T35 and is detected by the light sensor 522 on the opposite side. In such a way, the first detection unit 52 can perform the detection operation with ease without increasing movable portions.

Furthermore, it is determined whether or not the operation of the hour hand 3 is resumed based on the fact that it becomes impossible to detect the transparent holes T31, t32 and T35 in the usual detection processing for 11:55 a.m./p.m. and 5:55 a.m./p.m., and accordingly, electric power consumption by excessive detection operations with respect to the long-period stop is not required.

Moreover, in the case where the transmitted light is not detected in the transparent holes T31, T32 and T35 at 11:55 a.m./p.m., it is determined that the position of the hour hand 3 is shifted, and the correction operation for the hand position is performed, and accordingly, it is possible to separately cope with a positional shift of hand, which occurs in usual.

Moreover, in the event where the positional shift of the hour hand 3 is attempted to be corrected, in the case where the hour hand 3 is not detected by the first detection unit 52 though the control signal for making one rotation (12 hours) of the hour hand 3 is outputted, then it is determined that the hour hand 3 cannot operate owing to the external magnetic field and the like in a similar way to the case where the transparent holes are stopped at the position D1, and a shift between the time/date counted by the time counting circuit 46 and the time/date displayed on the date indicator 2 is recognized, whereby the positions of the hour hand 3 and the date indicator 2 can be corrected rapidly after the operation of the hour hand 3 is resumed.

Moreover, with regard to the positional shift of the hour hand 3, the correction thereof is attempted at a time interval shorter than 12 hours, whereby inaccurate time display cannot be allowed to continue for a long period after the operation of the hour hand 3 is resumed, and the analog electronic time piece 1 can be allowed to cope with use of the user.

Furthermore, the processing related to the date shift in the case where the hour hand 3 is stopped at the position of 11:55 a.m./p.m. for one day or more and the processing related to the date shift in the case where the hour hand 3 is stopped at the position other than that of 11:55 a.m./p.m. for one day or more are integrated with each other, whereby the date shift can be corrected as appropriate while accurately maintaining consistency between the time counted by the time counting circuit 46 and the memory positions of the hour hand 3 and the date indicator 2 without complicating the processing after the operation of the hour hand 3 is resumed.

Moreover, the operation unit 50 is provided, and the user performs a predetermined operation by using this operation unit 50, whereby the hour hand 3 and the date indicator 2 can be rotated even manually by every predetermined number of steps. Accordingly, at such a time when the date data memorized in the RAM 43 is reset, it is also possible for the user to set the date data with ease. Moreover, at this time, a configuration in which it is possible to fast-forward the date in a lump of one rotation of the hour hand 3 is adopted, whereby labor related to such a manual date alignment operation can be reduced.

Note that the present invention is not limited to the above-described embodiment, and is modifiable in various ways.

For example, in the above-described embodiment, the detection confirmation of the transparent holes and the time correction operation are performed at 11:55 a.m./p.m. by the first detection unit 52, and moreover, the confirmation of the non-detection is performed thereby at 5:55 a.m./p.m.; however, the present invention is not limited to this time. In general, desirably, the time correction operation is performed in a time band while it is less possible to be seen by the user. Moreover, in the analog electronic timepiece 1 of this embodiment, a configuration may also be adopted, in which the time correction operation is performed immediately after a usual date change operation, for example, at 1:05 a.m. so as not to be performed simultaneously with the usual date change operation concerned.

Moreover, in the above-described embodiment, the detection confirmation by the first detection unit 52 and the confirmation of the non-detection thereby are performed alternately at intervals of six hours; however, the present invention is not limited to this time setting. The confirmation of the non-detection can be performed at appropriate timing when the non-detection state must continue during a period between the two times of the detection confirmation, as long as the detection confirmation and the confirmation of the non-detection are performed alternately.

Moreover, in the above-described embodiment, the same detection pattern is only obtained in the cycle of 12 hours in the normal state; however, the arrangement of the transparent holes in the gears is changed, whereby such arrangement may be made so that the transparent holes can be detected at reference timing and after the elapse of four hours therefrom, and that it can be detected that the transparent holes are not detected after the elapse of two hours and eight hours from the reference timing. Even in the case where the plurality of transparent holes are provided as described above, the operation state of the hour hand 3 can be detected while uniquely specifying the position thereof.

Moreover, the above-described embodiment mentions, as an example, the display which is made by the hour hand 3 that makes one rotation for 12 hours, and by the date indicator 2 that rotates in conjunction with the hour hand 3 for two hours and 30 minutes while the hour hand 3 is making two rotations. However, in a similar way, the present invention can also be applied to other cases, for example, such a case of a date indicator 2 that moves partially in conjunction with one rotation of a 24-hour hand, such a case of morning/afternoon display that moves partially in conjunction with every rotation with respect to one rotation of the hour hand 3, or a case where two hands simply rotate in conjunction with each other in a predetermined ratio.

Moreover, in the above-described embodiment, there is illustrated the configuration in which the hand positions are identified in such a manner that the emitted light coming from the light emitting unit 521 penetrates the transparent holes and is received by the light sensor 522; however, the present invention is not limited to this configuration. For example, it may be made possible to detect the hand positions in such a manner that a conductive portion is provided and electricity flows therethrough at predetermined timing.

Moreover, in the above-described embodiment, the description is made of the combination of the hands and the rotation plate (date indicator 2); however, the present invention is not limited to this. For example, a configuration of rotating not a rigid body such as the rotation plate but a belt-like date display portion may be adopted, or alternatively, the hands may also be allowed to perform the display of the date.

Moreover, on the contrary, the rotation plate and the like, which are other than the hands, may also be allowed to perform the display of the time.

Besides the above, specific details such as: the presence of a function hand driven by another motor; the operation mechanism for the minute hand 4 and the second hand 5; the confirmation method of the hand positions; the configuration and arrangement of the respective gear train mechanisms; and the control procedure related to the detection operations for the hour hand 3, are changeable as appropriate within the scope without departing from the spirit of the present invention.

The description has been made of some embodiments of the present invention; however, the scope of the present invention is not limited to the above-mentioned embodiments, and incorporates the scope of inventions, which is described in the scope of claims, and the scope equivalent thereof.

The entire disclosure of Japanese Patent Application No. 2012-168507 filed on Jul. 30, 2012 including description, claims, drawings, and abstract are incorporated herein by reference in its entirety.

What is claimed is:

1. An analog electronic timepiece comprising:

a plurality of rotating display bodies which indicate a current time and date in such a manner that display modes corresponding to rotation operations thereof are combined with one another;

a gear train mechanism in which a plurality of gears are arrayed, the plurality of gears rotating a second rotating display body among the plurality of rotating display bodies by a predetermined angle in conjunction with a rotation of a first rotating display body among the plurality of rotating display bodies every time the first rotating display body makes one rotation;

a drive control unit which performs drive control for a rotation operation of the gear train mechanism;

a detection unit which detects whether or not the first rotating display body is in a predetermined reference display mode; and a delay cycle counting unit which counts a number of delay cycles, the number indicating a rotation delay amount of the display mode of the first rotating display body, wherein the delay cycle counting unit adds 1 to the number of delay cycles in a case where it is determined, for each detection cycle of the predetermined reference display mode, that the first rotating display body is stopped during a rotation cycle of the first rotating display body based on detection results by the detection unit at a first timing when the detection unit is scheduled to detect that the first rotating display body is in the predetermined reference display mode and at a second timing different from the first timing, and the drive control unit rotationally moves the first rotating display body for a number of times, the number corresponding to the number of delay cycles, in a case where the first rotating display body is capable of operating at the first timing.

2. The analog electronic timepiece according to claim 1, wherein a length of the detection cycle and a length of the rotation cycle of the first rotating display body are set equal to each other, and the delay cycle counting unit adds 1 to the number of delay cycles in a case where the predetermined reference display mode is detected continuously at the first timing, at the second timing and at the first timing that comes next in the detection cycle.

3. The analog electronic timepiece according to claim 2, wherein, in the gear train mechanism, the plurality of gears are arrayed so as to rotate the second rotating display body in a predetermined cycle in conjunction with the rotation of the first rotating display body only in a predetermined period.

4. The analog electronic timepiece according to claim 3, wherein, in the second rotating display body, marks indicating dates are provided in a date order on one surface, and a displayed date is changed by one day by the rotation of the second rotating display body in the predetermined period.

5. The analog electronic timepiece according to claim 4, wherein the first rotating display body is an hour hand, and the gear train mechanism rotates the second rotating display body during the predetermined period every time the first rotating display body makes two rotations.

6. The analog electronic timepiece according to claim 5, further comprising:

a dial which is provided above the second rotating display body, wherein a window portion is provided on the dial, and one of the marks provided on the one surface of the second rotating display body is made selectively exposable in response to the rotation of the second rotating display body.

7. The analog electronic timepiece according to claim 2, wherein the detection unit detects a detection target portion at a position corresponding to the predetermined reference display mode, the detection target portion being provided on a predetermined gear among the plurality of gears.

8. The analog electronic timepiece according to claim 2, wherein the drive control unit determines that the first rotating display body returns from an operation stop state to an operation enable state in a case where the predetermined reference display mode is not detected at the first timing or at the second timing after the predetermined reference display mode is detected by the detection unit at the second timing.

9. The analog electronic timepiece according to claim 2, further comprising:

a position correction unit which, in a case where the predetermined reference display mode is not detected at the first timing, allows the detection unit to perform a detection operation every time of allowing the drive control unit to rotationally move the first rotating display body by one step, thereby detects the predetermined reference display mode, identifies a rotation position of the first rotating display body, and corrects the rotation position of the first rotating display body.

10. The analog electronic timepiece according to claim 1, wherein, in the gear train mechanism, the plurality of gears are arrayed so as to rotate the second rotating display body in a predetermined cycle in conjunction with the rotation of the first rotating display body only in a predetermined period.

11. The analog electronic timepiece according to claim 10, wherein, in the second rotating display body, marks indicating dates are provided in a date order on one surface, and a displayed date is changed by one day by the rotation of the second rotating display body in the predetermined period.

12. The analog electronic timepiece according to claim 11, wherein the first rotating display body is an hour hand, and the gear train mechanism rotates the second rotating display body during the predetermined period every time the first rotating display body makes two rotations.

13. The analog electronic timepiece according to claim 12, further comprising:

a dial which is provided above the second rotating display body, wherein a window portion is provided on the dial, and one of the marks provided on the one surface of the second rotating display body is made selectively exposable in response to the rotation of the second rotating display body.

14. The analog electronic timepiece according to claim 1, wherein the detection unit detects a detection target portion at a position corresponding to the predetermined reference display mode, the detection target portion being provided on a predetermined gear among the plurality of gears.

15. The analog electronic timepiece according to claim 1, wherein the drive control unit determines that the first rotating display body returns from an operation stop state to an operation enable state in a case where the predetermined reference display mode is not detected at the first timing or at the second timing after the predetermined reference display mode is detected by the detection unit at the second timing.

16. The analog electronic timepiece according to claim 1, further comprising:

a position correction unit which, in a case where the predetermined reference display mode is not detected at the first timing, allows the detection unit to perform a detection operation every time of allowing the drive control unit to rotationally move the first rotating display body by one step, thereby detects the predetermined reference display mode, identifies a rotation position of the first rotating display body, and corrects the rotation position of the first rotating display body.

17. The analog electronic timepiece according to claim 16, wherein the position correction unit determines that the first rotating display body is in an operation stop state in a case where the predetermined reference display mode is not detected though the first rotating display body is allowed to move by an amount of one cycle at the first timing.

18. The analog electronic timepiece according to claim 17, wherein the position correction unit operates at an interval shorter than an interval from the first timing to the second timing until the rotation position of the first rotating display body is identified in a case where the position correction unit determines that the first rotating display body is in the operation stop state at the first timing.

19. The analog electronic timepiece according to claim 18, wherein a length of the detection cycle and a length of the rotation cycle of the first rotating display body are set equal to each other, and the delay cycle counting unit adds 1 to the number of delay cycles in a case where the predetermined reference display mode is not detected continuously during the detection period.

20. The analog electronic timepiece according to claim 1, further comprising:

an operation unit which receives an external operation and converts the external operation into an input signal, wherein the drive control unit rotates the first rotating display body and the second rotating display body by every predetermined number of steps based on the input signal.

* * * * *